US006227289B1

(12) United States Patent
Yokoyama et al.

(10) Patent No.: US 6,227,289 B1
(45) **Date of Patent: *May 8, 2001**

(54) FINNED HEAT EXCHANGER

(75) Inventors: Shoichi Yokoyama; Hitoshi Motegi, both of Shiga (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/745,344

(22) Filed: Nov. 8, 1996

(30) Foreign Application Priority Data

Nov. 9, 1995 (JP) ..... 7-291011

(51) Int. Cl.[7] ..... F28D 1/04; F28F 13/00
(52) U.S. Cl. ..... 165/151; 165/135
(58) Field of Search ..... 165/151, 181, 165/135, 140

(56) References Cited

U.S. PATENT DOCUMENTS

| | | | | |
|---|---|---|---|---|
| 2,963,277 | * | 11/1960 | Heller et al. | 165/151 |
| 4,434,844 | * | 3/1984 | Sakitani et al. | 165/151 |
| 4,723,599 | * | 2/1988 | Hanson | 165/151 |
| 5,042,576 | * | 8/1991 | Broadbent | 165/151 |
| 5,076,353 | * | 12/1991 | Haussmann | 165/151 |
| 5,117,902 | * | 6/1992 | Kusuhara et al. | 165/151 |
| 5,170,842 | * | 12/1992 | Kata et al. | 165/151 |
| 5,692,561 | * | 12/1997 | Kang et al. | 165/151 |
| 5,697,432 | * | 12/1997 | Yun et al. | 165/151 |
| 5,706,885 | * | 1/1998 | Kim | 165/151 |

FOREIGN PATENT DOCUMENTS

| | | |
|---|---|---|
| 63-183391 | 7/1988 | (JP) . |
| 2-64396 | 3/1990 | (JP) . |
| 2-217792 | 8/1990 | (JP) . |

* cited by examiner

*Primary Examiner*—Ira S. Lazarus
*Assistant Examiner*—Tho Duong
(74) *Attorney, Agent, or Firm*—McDermott, Will & Emery

(57) ABSTRACT

A finned heat exchanger characterized by disposing main plural raised portions 24*a*, 24*b*, 24*c* only on one side of the surfaces of fins 11, between heat transfer tubes 13 adjacent in the transverse direction, defining the width Wf of the raised portions 24*a*, 24*b*, 24*c* in the principal direction of air stream at about ⅓ of the distance Wb between adjacent raised portions in the principal direction of an air stream, and disposing grooved insulating means such as slits 31, slots 32, or raised portions 33*c*, 35, 37 in the portion of the fins where there is a temperature difference between fluids flowing in adjacent heat transfer tubes 13 in the principal direction of air stream, said insulating means disposed on the surface of the fins 11 near the middle of the fins between adjacent heat transfer tubes 13 in the principal direction of the air stream to suppress the conduction of heat through the fins caused by fluids flowing in adjacent heat transfer tubes in the principal direction of air stream, and to effectively enhance the heat exchange capacity and the heat transfer efficiency by the leading edge effect of temperature boundary layer of the slits 31, slots 32, or raised portions 33*c*, 35, 37.

9 Claims, 6 Drawing Sheets

FINNED HEAT EXCHANGER

BACKGROUND OF THE INVENTION

The present invention relates to a finned heat exchanger used widely in the field of air-conditioners or refrigerating machines.

Recently, along with the trend for smaller and thinner structures for air-conditioners, a further enhancement of the heat exchange capacity is being demanded in finned heat exchangers.

FIG. 7A and FIG. 7B are plan and sectional views of a prior art finned heat exchanger having an improved heat exchange capacity, which was disclosed in Japanese Laid-Open Patent No. Hei 2-217792. A plurality of fin collars 12 are burred at a right angle to each plate fin 11. The fin collars 12 are spaced at specific intervals on the plate fins. A heat transfer tube 13 is inserted into the fin collars 12, aligned with each other on different plate fins and is expanded to contact tightly within the fin collars 12. Arrow B shows a principal direction of an air stream. Between adjacent fin collars 12 on each plate fin, three rows of raised portion groups 14*a*, 14*b*, 14*c* are formed on one side of each plate fin 11. The three rows of raised portion groups are composed of one raised portion 14*a*, two raised portions 14*b*, and three raised portions 14*c*. The width Wf of a raised portion is formed to be about ⅓ of a flat fin width Wb of a fin between raised portions.

In the finned heat exchanger, shown in FIG. 7A and FIG. 7B, the air flow pressure drop was decreased and the heat exchange capacity was improved. However, if there is a temperature difference between the fluids flowing in the heat transfer tubes 13, heat exchange occurs due to heat conduction through the flat portion of the plate fins in the wide areas thereon. As a result, the improvement in the heat exchange capacity of the Hei application was found to be insufficient. In particular, forming plural rows of heat transfer tubes in the finned heat exchanger shown in FIG. 7A and FIG. 7B, and having fluids flowing in the heat transfer tubes with a temperature difference in the fluids flowing in the heat transfer tubes adjacent in rows, the fluids flowing in the individual heat exchange tubes exchange heat with each other by heat conduction through the flat fin area having a wide area. Accordingly, if the finned heat exchanger in FIG. 7A and FIG. 7B is used in plural rows, the Hei heat exchanger lacks sufficient heat exchange capacity.

SUMMARY OF THE INVENTION

It is hence an object of the invention to suppress heat conduction through the plate fins if there is a temperature difference between fluids flowing in adjacent heat transfer tubes, and to enhance the heat exchange capacity of heat exchangers.

In particular, the finned heat exchanger of the present invention comprises plate fins, fin collars provided at a right angle to the plate fins, heat transfer tubes inserted in the fin collars, plural raised portions provided only on one side of the fin surface between adjacent heat transfer tubes, with the width being about ⅓ of the width of the wide area between the adjacent raised portions in the flat portion of the plate fin, and additional insulating means in the form of grooves such as slits, slots or raised portions are provided in the fins near the middle of or midway between adjacent rows of heat transfer tubes, in an area of temperature difference between fluids flowing in adjacent heat transfer tubes.

The invention itself, together with further objects and attendant advantages, will best be understood by reference to the following detailed description taken in conjunction with the accompanying figures.

DETAILED DESCRIPTION OF THE INVENTION

Figure 1:
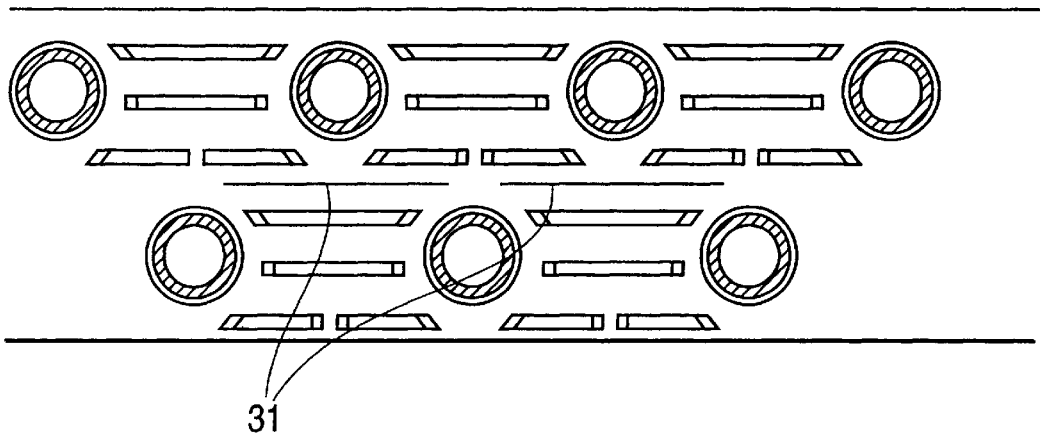
FIG. 1 is a plan view of fins of a finned heat exchanger according to a first embodiment of the invention.

Referring now to the drawings, the embodiments of the finned heat exchanger of the present invention are described in detail below.

First, the structure or construction common to the embodiments of the present invention is described by reference to FIG. 6A and FIG. 6B.

Figure 6A:
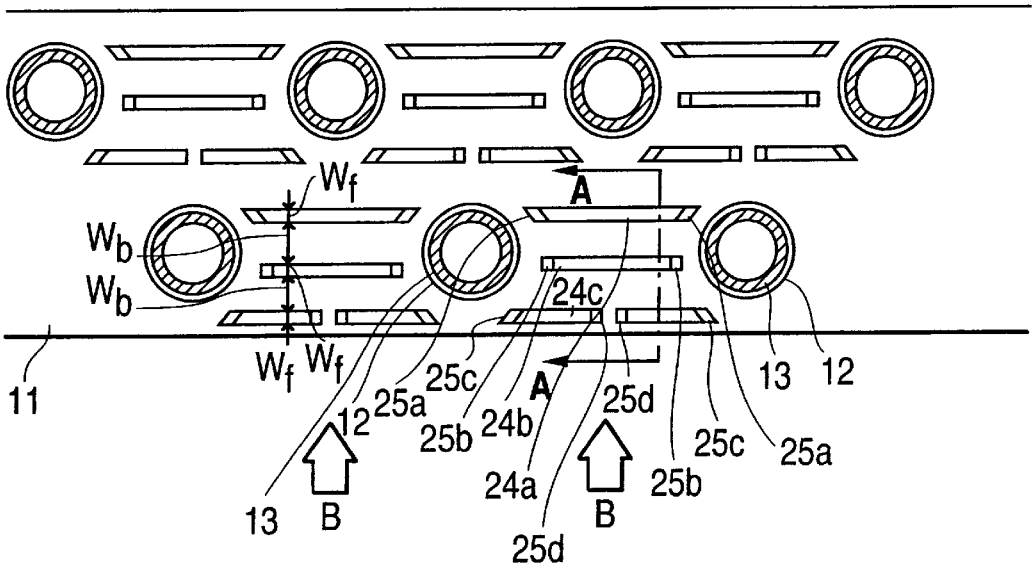
FIG. 6A is a plan view showing a common constitution of the fins of the finned heat exchangers in the foregoing embodiments of the invention.
Figure 6B:
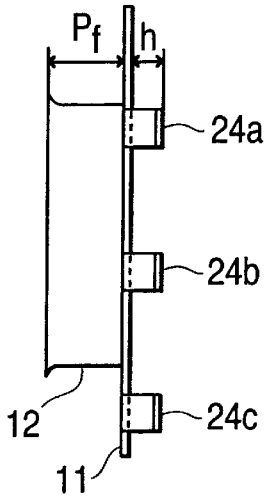
FIG. 6B is a sectional view of line A—A in FIG. 6A.
Figure 7A:
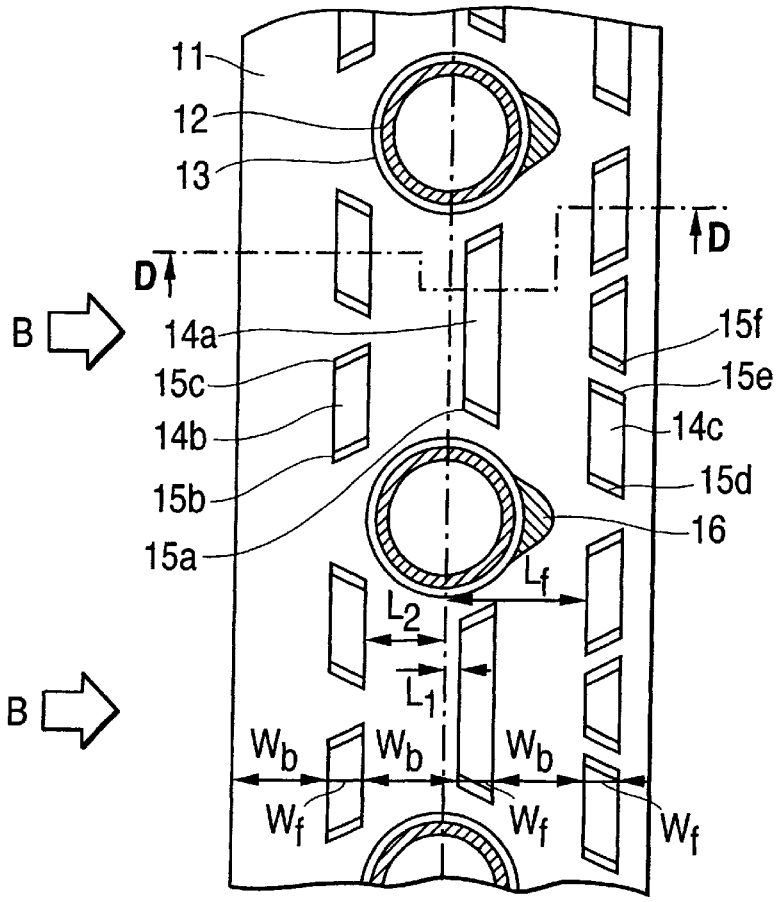
FIG. 7A (PRIOR ART)
FIG. 7A is a plan view of fins of a finned heat exchanger disclosed in Japanese Laid-Open Patent No. Hei 2-217792.
Figure 7B:
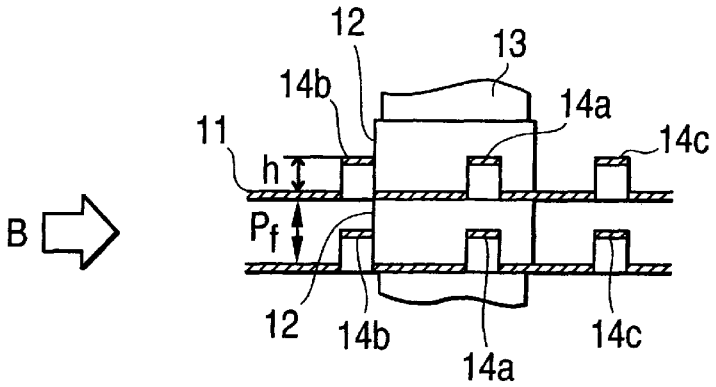
FIG. 7B (PRIOR ART)
FIG. 7B is a sectional view along line D—D in FIG. 7A.

FIG. 6A is a plan view showing a common construction of the fins of the finned heat exchangers according to the foregoing embodiments of the present invention. FIG. 6B is a sectional view along line A—A in FIG. 6A.

As shown in FIG. 6A, plural fins 11 are laid down parallel to each other at specific intervals of fin pitch Pf, and air stream flows among or between the fins. The principal direction B of an air stream is the arrow direction. Specifically, air flows at a right angle to the leading edge of the fins. For the sake of simplicity, the direction at a right angle to the principal direction B of the air stream on the fin surface is called the transverse direction. Fin collars 12 are formed by burring at a right angle to the fins. A plurality of fin collars 12 are arranged in a straight row in the transverse direction at a specific pitch, which is called a transverse pitch of the heat transfer tube. Plural rows of fin collars are arranged at a specific pitch in the transverse direction. Heat transfer tubes 13 are inserted into the fin collars 12, and expanded to contact tightly within the fin collars 12. The heat transfer tubes are arranged as a row of heat transfer tubes in the transverse direction. Between two adjacent heat transfer tubes 13 in the transverse direction, a group of three rows of raised portions are arranged, opened to the principal direction B of air stream. The group of three rows of raised portions are formed on a same side of the surface of the fins 11, for example, on the side opposite to the side to which the fin collars 12 are arranged. A group of three rows of raised portions comprises, one raised portion 24*a*, one raised portion 24*b*, and two raised portions 24*c* along the transverse direction, all of which portions are called "main raised portions". The width Wf of each raised portion in the principal direction B of air stream is preferably formed to be about ⅓ of the width Wb of the continuous fin flat portion not forming raised portions of the fins 11 in the principal direction of air stream. Riser portions 25*a*, 25*b*, 25*c* of the respective raised portions 24*a*, 24*b*, 24*c*, adjacent the neighboring side of a heat transfer tube 13, are preferably located in the direction of, and near the position of, the outer circumference of a heat transfer tube 13 . Riser portions 25*d* of the two raised portions 24*c*, not adjacent the neighboring side of the heat transfer tubes 13, are preferably formed in the approximate direction of, and along the principal direction B of the air stream. The height h of the raised portions 24*a*, 24*b*, 24*c* is preferably formed at about ½ of the fin pitch Pf.

A finned heat exchanger according to a first embodiment of the invention is described by referring to a plan view in FIG. 1. In FIG. 1, reference numerals common to FIGS. 5A, 5B and FIGS. 6A, 6B are omitted. An insulating means in the form of a narrow groove or slit 31 is formed between adjacent rows of the fin collars in the fins at a location approximately midway between adjacent heat transfer tubes 13, and transverse to the principal direction of air stream, preferably long in the transverse direction. The length of the slit 31 is, preferably, longer than the diameter of a heat transfer tube, and is formed less than two times the transverse pitch of the heat transfer tube in the transverse direction. The groove or slit 31 is slight in width, penetrating through the face and back side in the fin thickness direction.

Figure 2:
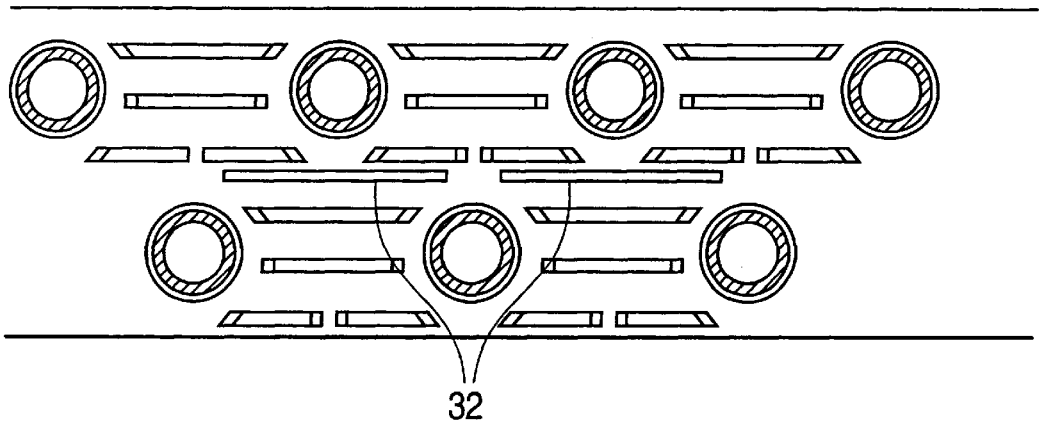
FIG. 2 is a plan view of fins of a finned heat exchanger according to a second embodiment of the invention.

A finned heat exchanger according to a second embodiment of the invention is described by referring to a plan view in FIG. 2. Reference numeral 32 is an alternate for of insulating means in the form of a slightly wider groove than the slit 31, that is, a slot, which is formed between adjacent rows of fin collars in a manner similar to the slit in FIG. 1. Specifically, the wider groove or slot 32 is provided near the middle of a fin between adjacent heat transfer tubes 13 and in the transverse direction, preferably long in the transverse direction. The length of the groove or slot 32 is preferably more than the diameter of the heat transfer tube, being formed less than two times the transverse pitch of the heat transfer tube in the transverse direction. The groove or slot 32 penetrates through the face and back side in the thickness direction of the fin, having a specific width that is wider than the slit.

Figure 3A:
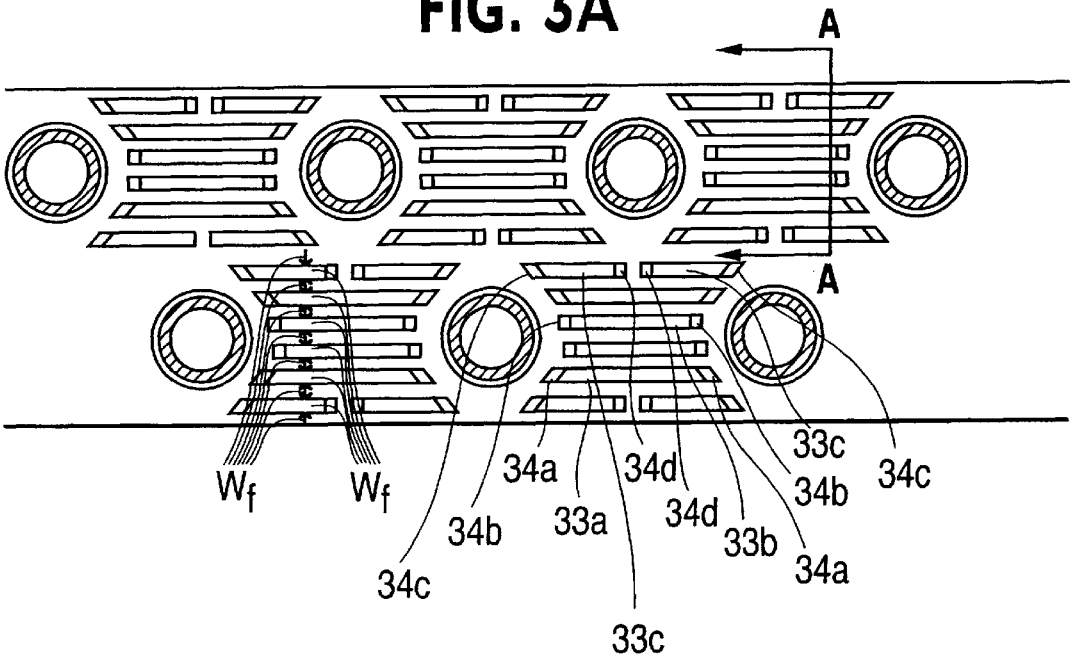
FIG. 3A is a plan view of fins of a finned heat exchanger according to a third embodiment of the invention.
Figure 3B:
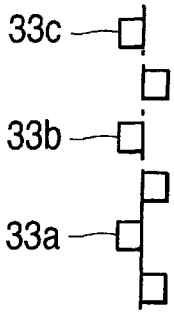
FIG. 3B is a sectional view of line A—A in FIG. 3A.

A finned heat exchanger according to a third embodiment of the invention is described by referring to a plan view in FIG. 3A and a sectional view in FIG. 3B. Between two adjacent heat transfer tubes 13 in the transverse direction, a group of six rows of raised portions, opened to the principal direction B of air stream, are provided in the fins 11. In addition to the three rows of main raised portions 24*a*, 24*b*, 24*c* described in FIG. 6A and FIG. 6B, one raised portion 33*a*, one raised portion 33*b*, and two raised portions 33c are formed between two adjacent heat transfer tubes 13 in the principal direction of air stream, on the opposite side of the location of the main raised portions 24*a*, 24*b*, 24*c*, having the same width Wf as the raised portions 24*a*, 24*b*, 24*c*, and located on the opposite side in an alternating manner with the raised portions 24*a*, 24*b*, 24*c*, that is, alternately on the face and back sides of the fins. Rise portions 34*a*, 34*b*, 34*c*, of the raised portions 33*a*, 33*b*, 33*c*, that are located adjacent to, or at the neighboring side of, the heat transfer tubes 13 are preferably located in the direction and position nearly along the outer circumference of the heat transfer tubes 13. The riser portions 34*d*, of the raised portions 33*c*, not at the neighboring side of the heat transfer tubes 13 are preferably formed in a direction nearly along the principal direction B of air stream. The height h of the raised portions 33*a*, 33*b*, 33*c* is formed preferably about ½ of the fin pitch Pf.

Figure 4A:
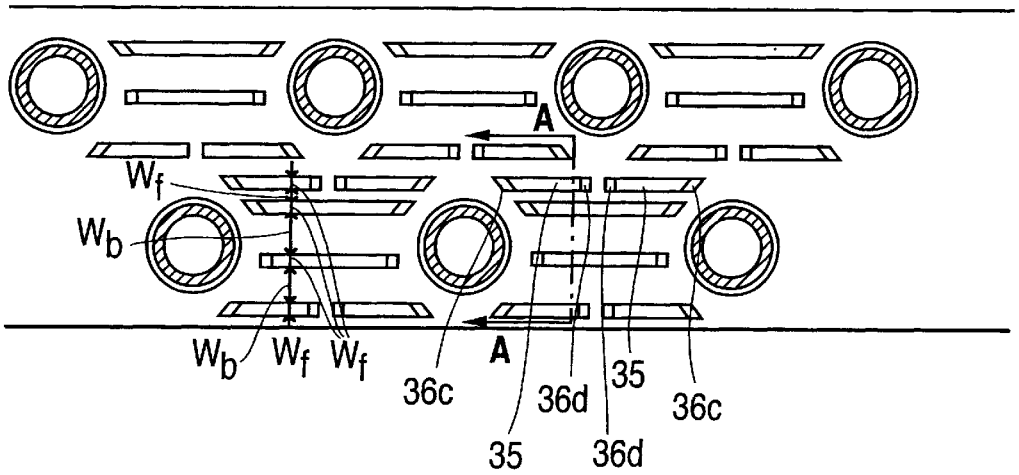
FIG. 4A is a plan view of fins of a finned heat exchanger according to a fourth embodiment of the invention.
Figure 4B:
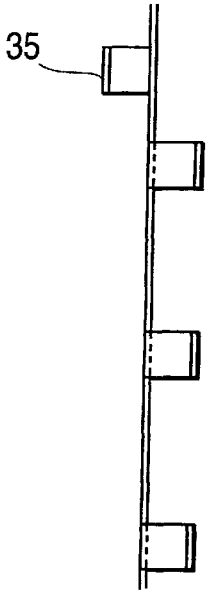
FIG. 4B is a sectional view of line A—A in FIG. 4A.

FIG. 4A is a plan view of fins of a finned heat exchanger according to a fourth embodiment of the invention, and FIG. 4B is a sectional view of line A—A in FIG. 4A. The fourth embodiment is a modification of the embodiment depicted in FIG. 1 in that two additional raised portions 35 are included on the fins.

Two raised portions 35 are formed between adjacent fin collar rows forming the row of fin collars nearest the leading edge of the air stream, and provided on the surface of the fins 11, approximately midway between the rows of heat transfer tubes 13, in the transverse direction, on the opposite side of the location of the main raised portions 24*a*, 24*b*, 24*c*, in the same width Wf as the raised portions 24*a*, 24*b*, 24*c*. Each riser portion 36*c*, of the raised portions 35, at the neighboring side of the heat transfer tube 13 is preferably located in the direction and position nearly along the outer circumference of the heat transfer tube 13. Riser portions 36d, of the raised portions 35, which are not at the neighboring side of a heat transfer tube 13, are preferably formed in a direction nearly along the principal direction B of air stream. The height h of the raised portion 35 is formed preferably about ½ of the fin pitch Pf.

Figure 5A:
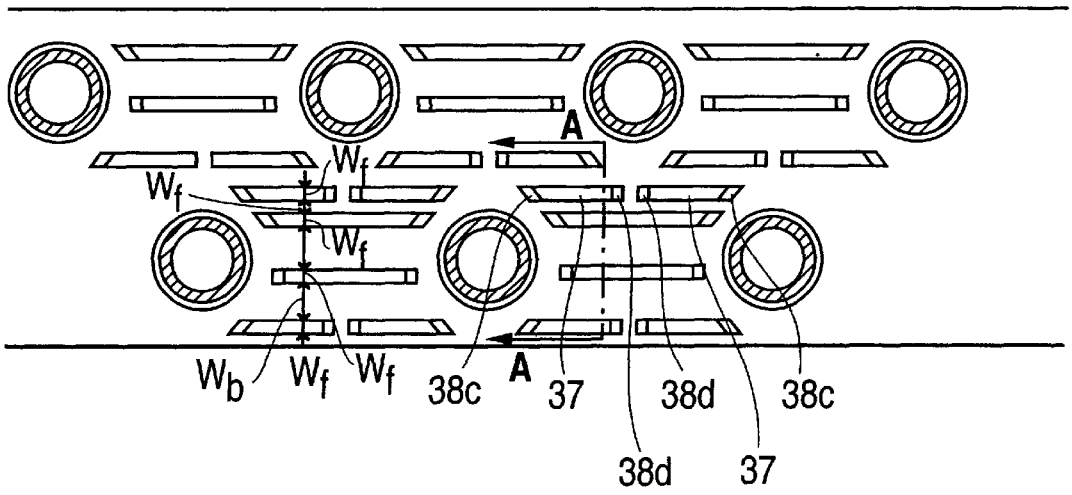
FIG. 5A is a plan view of fins of a finned heat exchanger according to a fifth embodiment of the invention.
Figure 5B:
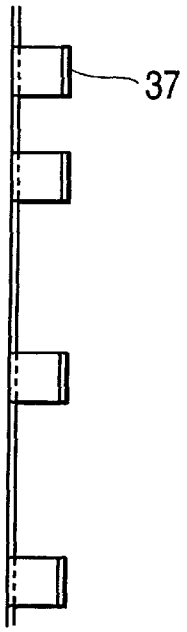
FIG. 5B is a sectional view of line A—A in FIG. 5A.

FIG. 5A is a plan view of fins of a finned heat exchanger according to a fifth embodiment of the invention, and FIG. 5B is a sectional view of line A—A in FIG. 5A. The fifth embodiment is similar to the embodiment depicted in FIGS. 4A and 4B, except that the two additional raised portions 37 are located on the same side of the fins as the main raised portions.

Two raised portions 37 are formed between adjacent fin collars that form the row of fin collars nearest the leading edge of the air stream, and provided on the surface of the fins 11, approximately midway between the rows of heat transfer tubes 13, in the transverse direction, on the same side of the location of the main raised portions 24*a*, 24*b*, 24*c*, in the same width Wf as the raised portions 24*a*, 24*b*, 24*c*. Each riser portion 38*c*, of the raised portions 37, at the neighboring side of the heat transfer tube 13 is preferably located in the direction and position nearly along the outer circumference of the heat transfer tube 13. Riser portions 38d, of the raised portions 37, which are not at the neighboring side of the heat transfer tube 13, are preferably formed in a direction nearly along the principal direction B of air stream. The height h of the raised portion 37 is formed preferably about ½ of the fin pitch Pf.

The fin shape of the finned heat exchangers, according to the first through fifth embodiments of the invention, is employed or formed in the portions of the heat exchanger having a temperature difference between fluids flowing inside the heat transfer tubes 13 adjacent to the principal direction of air stream. On the other hand, the fin shape depicted in FIG. 6A and FIG. 6B is employed in the other portions of the heat exchanger. Further, the fin shape of the finned heat exchangers depicted in FIGS. 4A and 4B and FIGS. 5A and 5B of the fourth and fifth embodiments, respectively, may be used in all regions of the heat exchanger.

The embodiments described above provide a number of significant advantages, as for example:

(1) By disposing the main plural raised portions 24*a*, 24*b*, 24*c* only on one side of the surfaces of the fins 11 between adjacent heat transfer tubes 13 in the transverse direction, defining the width Wf of the raised portions 24*a*, 24*b*, 24*c* in the principal direction of air stream to be about ⅓ of the distance Wb between adjacent raised portions in the principal direction of air stream, and disposing insulating means such as grooves in the form of slits 31, slots 32 or raised portions 33*c*, 35, 37 in the portion having a temperature difference between fluids flowing in adjacent heat transfer tubes 13 in the principal direction of air stream, on the surface of the fins 11 near the middle between adjacent heat transfer tubes 13 in the principal direction of air stream, conduction of heat through fins is suppressed between fluids flowing in adjacent heat transfer tubes in the principal direction of air stream, heat exchange capacity in plural rows is effectively enhanced, as is the heat transfer efficiency by the leading edge effect of temperature boundary layer of the slits 31, slots 32, or raised portions 33*c*, 35, 37.

The heat exchange capacity is not improved sufficiently if only the main plural raised portions 24*a*, 24*b*, 24*c* are disposed on the surfaces of fins, because there are wide flat areas on the fins and heat exchange occurs due to heat conduction through the wide flat areas of the flat portion of the fins. Moreover, the heat exchange capacity is not improved sufficiently if only many raised portions are disposed in the fins because the air flow pressure drop increased.

Also, the heat exchange capacity is not improved sufficiently if only insulating means such as slits 31, slots 32 or raised portions 33*c*, 35, 37 are disposed on the surface of the fins 11 near the middle between the heat transfer tubes 13 adjacent in the principal direction of air stream.

However, a significant improvement in the heat exchange capacity is obtained by disposing main plural raised portions 24*a*, 24*b*, 24*c* on the surfaces of fins and by disposing grooved insulating means such as slits 31, slots 32 or raised portions 33*c*, 35, 37 on the surface of the fins 11 near the middle between the heat transfer tubes 13 adjacent in the principal direction of air stream.

(2) By defining the longitudinal direction of the grooves forming insulating means such as slits 31, slots 32 or the raised portions 33*c*, 35, 37 formed on the surface of the fins 11 near the middle, between the adjacent heat transfer tubes rows in the principal direction of the air stream, the conduction of heat through the fin flat portions can be effectively suppressed between fluids flowing in the adjacent heat transfer tubes 13 in the principal direction of air stream.

(3) By defining the length of the insulating means in the transverse direction at more than the diameter of heat transfer tubes and less than two times the transverse pitch of a heat transfer tube in the transverse direction, the fin strength can be maintained, and the conduction of heat through the fin base can be economically suppressed between fluids flowing in the adjacent heat transfer tubes in the principal direction of air stream.

(4) By disposing plural raised portions 33*a*, 33*b*, 33*c* having the same width Wf as the main plural raised portions 24*a*, 24*b*, 24*c* on the surface of fins 11 provided with the main plural raised portions 24*a*, 24*b*, 24*c* adjacent to heat transfer tubes 13 adjacent the principal direction of the air stream, but on the opposite side of the fins from the location of the main plural raised portions 24*a*, 24*b*, 24*c*, in the middle between the main plural raised portions 24*a*, 24*b*, 24*c*, that is, alternately on the face and back side of the fins, conduction of heat through the fins between fluids is suppressed in the portion having a temperature difference between fluids flowing in the heat transfer tubes 13 adjacent to the principal direction of air stream, the heat exchange capacity in the plural rows is enhanced, and the heat transfer efficiency is enhanced by the leading edge effect of the temperature boundary layer of the plural raised portions 33*a*, 33*b*, 33*c*, provided these portions are on the opposite side of the location of the main plural raised portions 24*a*, 24*b*, 24*c*, that is, alternately on the face and back side of the fins.

(5) By disposing main plural raised portions 24*a*, 24*b*, 24*c* only on one side of the surfaces of fins 11 between adjacent heat transfer tubes 13 in the transverse direction, defining the width Wf of the raised portions 24*a*, 24*b*, 24*c* in the principal direction of air stream at about ⅓ of the distance Wb between adjacent raised portions in the principal direction of air stream, and disposing insulating means comprising grooves, such slits 31, or slots 32, in the portion of the fins having a temperature difference between fluids flowing in adjacent heat transfer tubes 13 in the principal direction of air stream, on the surface of the fins 11 near the middle between adjacent heat transfer tubes 13 in the principal direction of air stream, conduction of heat through the fins is suppressed between the fluids flowing in the adjacent heat transfer tubes in the principal direction of air stream, heat exchange capacity in the plural rows is effectively enhanced, and the heat transfer efficiency can be enhanced by the leading edge effect of the temperature boundary layer of the slits 31 or slots 32.

(6) By disposing main plural raised portions 24*a*, 24*b*, 24*c* only on one side of the surfaces of fins 11 between adjacent heat transfer tubes 13 in the transverse direction, defining the width Wf of the raised portions 24*a*, 24*b*, 24*c* in the principal direction of air stream at about ⅓ of the distance Wb between adjacent raised portions in the principal direction of air stream, and disposing raised portions 33*c*, 35, 37 in the portion having a temperature difference between fluids flowing in adjacent heat transfer tubes 13 in the principal direction of air stream, on the surface of the fins 11 near the middle between the heat transfer tubes 13 adjacent in the principal direction of air stream, conduction of heat through fins is suppressed between fluids flowing in the adjacent heat transfer tubes in the principal direction of air stream, heat exchange capacity in the plural rows is effectively enhanced, and heat transfer efficiency can be enhanced by the leading edge effect of the temperature boundary layer of the raised portions 33*c*, 35, 37.

Any improvement of heat exchange capacity is found to be insufficient if only many raised portions are disposed in the fins, because the air flow pressure drop is increased.

However, an improvement of heat exchange capacity is obtained by optimizing the number and the arrangement of the raised portions and depressing air flow pressure drop, and by defining the width Wf of the raised portions 24*a*, 24*b*, 24*c* in the principal direction of air stream at about ⅓ of the distance Wb between adjacent raised portions in the principal direction of air stream. Moreover, as for the position of the raised portions 33*c*, 35, 37, the most effective position is found to be in the portion of the fins having a temperature difference between of fluids flowing in adjacent heat transfer tubes 13 in the principal direction of air stream, on the surface of the fins 11 near the middle between adjacent heat transfer tubes 13 in the principal direction of air stream.

(7) By disposing a raised portion 35 with the same width Wf as the main plural raised portions 24*a*, 24*b*, 24*c* on the surface of fins 11 near the middle of the adjacent rows of heat transfer tubes 13 in the principal direction of air stream, on the opposite side of the location of the main plural raised portions 24*a*, 24*b*, 24*c*, conduction of heat through fins between fluids is suppressed in the portion having a temperature difference between fluids flowing in adjacent heat transfer tubes 13 in the principal direction of the air stream, heat exchange capacity in plural rows is enhanced, and heat transfer efficiency is enhanced by the leading edge effect of the temperature boundary layer of the raised portion 35 provided on the opposite side of the location of the main plural raised portions 24*a*,24*b*, 24*c*. Moreover, such a die can be obtained easily by modifying the fin having plural raised portions provided alternately in the face and back side of the fin.

(8) By disposing a raised portion 37 having the same width Wf as the main plural raised portions 24*a*, 24*b*, 24*c* on the surface of the fins 11 near the middle of the adjacent of heat transfer tubes 13 in the principal direction of air stream, on the same side of the fin as the location of the main plural raised portions 24*a*, 24*b*, 24*c*, conduction of heat through fins between fluids is suppressed in the portion having a temperature difference between fluids flowing in adjacent heat transfer tubes 13 in the principal direction of air stream, heat exchange capacity in the plural rows is enhanced, and heat transfer efficiency is enhanced by the leading edge effect of the temperature boundary layer of the raised portion 37, provided the raised portion 37 is formed on the same side of the fin as the location of the main plural raised portions 24*a*, 24*b*, 24*c*. As a result since all the raised portions are provided on the same side, the maintenance control of the die is easy.

(9) Supposing the number of raised portions 24*a*, 24*b*, 24*c*, 33*a*, 33*b*, 33*c*, 35, 37 to be n1, n2, n3, . . . sequentially from the one shortest in the distance from the straight line linking the centers of adjacent heat transfer tubes 13 in the transverse direction, by disposing the raised portions so that $n1 \leqq n2 \leqq n3 \leqq \ldots$, local velocity distribution hardly occurs at the downstream side of the air stream, and any increase in the air flow noise can be suppressed.

(10) By forming the riser portions 25*a*, 25*b*, 25*c*, 34*a*, 34*b*, 34*c*, 36*c*, 38*c*, of the raised portions 24*a*, 24*b*, 24*c*, 33*a*, 33*b*, 33*c*, 35, 37, at the neighboring side of heat transfer tubes 13 in the direction and at a position nearly along the outer circumference of the heat transfer tubes 13, the air flow stagnant area occurring at the rear stream side of the heat transfer tubes 13 can be decreased, and the effective heat transfer area can be increased. Moreover, since the distance from the heat transfer tubes 13 to the rise portions is short, the fin efficiency is high. On the other hand, since the total length of the raised portions is long, the portion greater in the leading edge effect of temperature boundary, layer can be kept long, and the heat transfer efficiency is improved.

(11) By forming riser portions 25*d*, 34*d*, 36*d*, 38*d*, of the raised portions 24*c*, 33*c*, 35, 37, located at the non neighboring side of the heat transfer tubes 13, in the direction nearly along the principal direction B of the air stream flowing among fins 11, a straightening effect of air flow is obtained, the air flow pressure drop is not increased much, and any elevation in the air flow noise can be controlled.

(12) By defining the height h of the raised portions 24*a*, 24*b*, 24*c*, 33*a*, 33*b*, 33*c*, 35, 37 as nearly at ½ of the fin pitch Pf, the air flow velocity among fins is made uniform, and any elevation in the air flow pressure drop may be decreased.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A finned heat exchanger through which a stream of air may flow, comprising:

a plurality of fins spaced at specific intervals and having a pair of surfaces parallel to each other;

a plurality of rows of heat transfer tubes, said tubes inserted through the fins at a right angle to the fins, with each row having a plurality of tubes disposed in a straight row at specific pitch in a direction at right angle to the principal direction of an air stream, and with said plurality of rows arranged at a specific pitch in a principal direction that is transverse to the air stream;

main plural raised portions disposed only on one of the surfaces of each of the fins between adjacent heat transfer tubes in a direction that is transverse to the air stream; and plural slits provided on the surface of each of the fins near the middle of each fin, between adjacent rows of heat transfer tubes in the principal direction of the air stream, and in the portion of each fin having a temperature difference between fluids flowing in adjacent heat transfer tubes in the principal direction of the air stream, wherein each of said plural slits are formed by cutting a respective fin in a manner whereby no portion of the fin is removed, and further wherein the width of the raised portions in the principal direction of air stream is nearly ⅓ of the distance between adjacent raised portions in the principal direction of the air stream.

2. The finned heat exchanger of claim 1, wherein said slits are formed along the transverse direction between adjacent heat transfer tube rows.

3. The finned heat exchanger of claim 1, wherein said slits are formed along the transverse direction between adjacent heat transfer tube rows, and wherein the length of the slits in the transverse direction is set at more than the diameter of heat transfer tube, and less than two times the transverse pitch of the heat transfer tube in the transverse direction.

4. The finned heat exchanger of claim 1, further comprising:

additional plural raised portions having the same width as said main plural raised portions, said additional plural raised portions being disposed on the opposite surface of each fin from the fin surface on which the main plural raised portions are located, in the middle of the main plural raised portions, that is, alternately on the front and back surface of each fin.

5. The finned heat exchanger of claim 1, wherein the raised portions include riser portions, and wherein said riser portions at the neighboring side of the heat transfer tubes are formed in the direction of, and positioned nearly along, an outer circumference of the heat transfer tubes.

6. The finned heat exchanger of claim 1, wherein the raised portions include riser portions, and wherein said riser portions at the non-neighboring side of the heat transfer tubes are formed in the approximate direction along the principal direction of the air stream.

7. The finned heat exchanger of claim 1, wherein the height of the raised portions is formed at nearly ½ of the fin pitch.

8. A finned heat exchanger through which a stream of air may flow, comprising:

a plurality of fins spaced at specific intervals and having a pair of surfaces parallel to each other;

a plurality of rows of heat transfer tubes, said tubes inserted through the fins at a right angle to the fins, with each row having a plurality of tubes disposed in a straight row at specific pitch in a direction at right angle to the principal direction of an air stream, and with said plurality of rows arranged at a specific pitch in a principal direction that is transverse to the air stream;

main plural raised portions disposed on the surfaces of each of the fins between adjacent heat transfer tubes in a direction that is transverse to the air stream; and plural slits provided on the surface of each of the fins near the middle of each fin, between adjacent rows of heat transfer tubes in the principal direction of the air stream, and in the portion of each fin having a temperature difference between fluids flowing in adjacent heat transfer tubes in the principal direction of the air stream, wherein each of said plural slits are formed by cutting a respective fin in a manner whereby no portion of the fin is removed, and further wherein the width of the raised portions in the principal direction of air stream is nearly ⅓ of the distance between adjacent raised portions in the principal direction of the air stream.

9. The finned heat exchanger of claim 1, wherein said slits are formed along the transverse direction between adjacent heat transfer tube rows, and wherein the length of the slits in the transverse direction is set at more than the diameter of heat transfer tube, and less than two times a transverse pitch of the heat transfer tube in the transverse direction.

* * * * *